US010917715B2

(12) United States Patent
Williams

(10) Patent No.: US 10,917,715 B2
(45) Date of Patent: Feb. 9, 2021

(54) ACOUSTIC TRANSDUCER WITH SPLIT DIPOLE VENTS

(71) Applicant: Bose Corporation, Framingham, MA (US)

(72) Inventor: Chester S. Williams, Lexington, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/101,483

(22) Filed: Aug. 12, 2018

(65) Prior Publication Data

US 2020/0053456 A1 Feb. 13, 2020

(51) Int. Cl.

*H04R 1/38* (2006.01)
*H04R 1/10* (2006.01)
*H04R 1/28* (2006.01)

(52) U.S. Cl.

CPC ..... *H04R 1/38* (2013.01); *H04R 1/1008* (2013.01); *H04R 1/1075* (2013.01); *H04R 1/2857* (2013.01); *H04R 2499/15* (2013.01)

(58) Field of Classification Search

CPC ..... H04R 1/38; H04R 1/1008; H04R 1/1075; H04R 1/2857; H04R 2499/15;

(Continued)

(56) References Cited

U.S. PATENT DOCUMENTS 4,562,590 A * 12/1985 DeLage ..... H04R 1/44 381/189
6,478,108 B1 * 11/2002 Linhard ..... H04R 1/345 181/141

(Continued)

FOREIGN PATENT DOCUMENTS

GB 2517486 2/2015

OTHER PUBLICATIONS

Pending unpublished U.S. Appl. No. 15/884,924, filed Jan. 31, 2018, Ray Scott Wakeland; et al.

(Continued)

*Primary Examiner* — Norman Yu
(74) *Attorney, Agent, or Firm* — Bond, Schoeneck & King, PLLC

(57) ABSTRACT

A loudspeaker including an acoustic radiator configured to emit front-side acoustic radiation from a front side and rear-side acoustic radiation from a rear side; a housing that directs the front-side acoustic radiation and the rear-side acoustic radiation; and a plurality of sound-emitting vents arranged in the housing. The plurality of sound-emitting vents includes a first sound-emitting vent arranged in a first end of the housing and a second sound-emitting vent in a second end of the housing. A first distance between the first and second sound-emitting vents defines a first effective length of a first loudspeaker dipole. The plurality of sound-emitting vents further includes third and fourth sound-emitting vents arranged in the housing. A second distance between the first sound-emitting vent and the third and fourth sound-emitting vents defines a second effective length of a second loudspeaker dipole. The second effective length is shorter than the first effective length.

18 Claims, 6 Drawing Sheets

(58) Field of Classification Search
CPC ..... H04R 2460/11; H04R 1/2826; H04R 1/2849; H04R 1/2823; H04R 1/025; H04R 1/02; H04R 1/2807; H04R 1/2815; H04R 1/2819; H04R 1/2873; H04R 1/2846; H04R 1/2869; H04R 1/2896
USPC ..... 381/345, 349, 338, 351, 353, 386; 181/148, 156
See application file for complete search history.

(56) References Cited

U.S. PATENT DOCUMENTS

| | | | | |
|---|---|---|---|---|
| 9,838,787 | B1 | 12/2017 | Jeffery et al. | |
| 9,949,030 | B2 | 4/2018 | Sun et al. | |
| 2004/0131219 | A1* | 7/2004 | Polk, Jr. ..... | H04R 1/2826 381/345 |
| 2008/0166002 | A1* | 7/2008 | Amsel ..... | H04R 1/025 381/370 |
| 2015/0237437 | A1* | 8/2015 | Hu ..... | H04R 1/1058 381/338 |
| 2015/0382100 | A1* | 12/2015 | Azmi ..... | H04R 1/1091 381/380 |
| 2017/0201823 | A1 | 7/2017 | Shetye et al. | |
| 2018/0048960 | A1 | 2/2018 | Jeffery et al. | |
| 2018/0167710 | A1 | 6/2018 | Silver et al. | |
| 2018/0295449 | A1* | 10/2018 | Morgan ..... | H04R 9/025 |
| 2019/0116411 | A1* | 4/2019 | Duckwall ..... | H04R 1/1008 |

OTHER PUBLICATIONS

Pending unpublished U.S. Appl. No. 15/897,453, filed Feb. 15, 2018, Ray Scott Wakeland; et al.
International Search Report and the Written Opinion of the International Searching Authority, International Application No. PCT/US2019/044833, pp. 1-22, dated Dec. 4, 2019.
Invitation to Pay Additional Fees and, Where Applicable, Protest Fee, International Application No. PCT/US2019/044833, pp. 1-18, dated Oct. 4, 2019.

* cited by examiner

ACOUSTIC TRANSDUCER WITH SPLIT DIPOLE VENTS

BACKGROUND

This disclosure relates to acoustic transducers.

Acoustic transducers of off-ear headphones are located farther from the ear and do not confine sound to the just the ear, and thus off-ear headphones produce more sound spillage that can be heard by others, as compared to on-ear headphones. Spillage can detract from the usefulness and desirability of off-ear headphones. Loudspeakers can be effective off-ear headphones, particularly loudspeakers having a variable effective dipole length. Variable effective dipole length of loudspeakers can accomplish a greater dipole spacing at lower frequencies, and a smaller dipole spacing at higher frequencies. Unfortunately, it is difficult to achieve smaller dipole spacing in acoustic systems that require larger acoustic drivers. In portable acoustic systems that are designed with larger acoustic drivers, for example, to reproduce low frequencies accurately, the more space that is occupied by the larger acoustic drivers means less space is available for placement of vents for achieving optimal dipole spacing.

SUMMARY

All examples and features mentioned below can be combined in any technically possible way.

In one aspect, a loudspeaker includes an acoustic radiator having a front side and a rear side, the acoustic radiator configured to emit front-side acoustic radiation from the front side and rear-side acoustic radiation from the rear side; a housing that directs the front-side acoustic radiation and the rear-side acoustic radiation; and a plurality of sound-emitting vents arranged in the housing. The plurality of sound-emitting vents includes a first sound-emitting vent arranged in a first end of the housing and a second sound-emitting vent in a second end of the housing, a first distance between the first and second sound-emitting vents defining a first effective length of a first loudspeaker dipole. The plurality of sound-emitting vents further includes third and fourth sound-emitting vents arranged in the housing, a second distance between the first sound-emitting vent and the third and fourth sound-emitting vents defining a second effective length of a second loudspeaker dipole, the second effective length being shorter than the first effective length.

In one example, the first loudspeaker dipole is a low frequency dipole and the second loudspeaker dipole is a high frequency dipole. In one example, the loudspeaker includes an acoustic transmission line between the acoustic radiator and the second sound-emitting vent configured to transmit sound pressure.

In one example, the first sound-emitting vent includes an opening in the housing covered by a resistive screen having a lowest possible resistance and a hydrophobic coating. In one example, the second sound-emitting vent includes a port opening.

In another aspect, the loudspeaker includes an extension member removably attachable to a headset configured to be worn on a user's head, wherein the acoustic radiator is held near but not covering an ear of the user when the loudspeaker is worn. In one example, when the extension member is attached to a headset, the extension member is slideable relative to the headset.

In one example, the first, second, third, and fourth sound-emitting vents include first, second, third, and fourth port openings, respectively, and the first port opening receives either the front-side acoustic radiation or the rear-side acoustic radiation, and the second, third, and fourth port openings receive either the front-side acoustic radiation or the rear-side acoustic radiation but do not receive the same acoustic radiation as does the first port opening.

In one example, the second effective length is shorter than a diameter of the acoustic radiator. In one example, the third and fourth sound-emitting vents are arranged in parallel and each extends from the first end of the housing to the second end of the housing.

In another aspect, a loudspeaker includes an acoustic radiator having a front side and a rear side, the acoustic radiator configured to emit front-side acoustic radiation from the front side and rear-side acoustic radiation from the rear side; a housing having first and second ends, the housing configured to direct the front-side acoustic radiation and the rear-side acoustic radiation; and a plurality of sound-emitting vents arranged in the housing. The plurality of sound-emitting vents includes a first sound-emitting vent arranged in the first end of the housing and second and third sound-emitting vents in the housing, a first distance between the first sound-emitting vent and the second and third sound-emitting vents defining a first effective length of a first loudspeaker dipole, the first effective length being shorter than a diameter of the acoustic radiator.

In one example, the plurality of sound-emitting vents further includes a fourth sound-emitting vent in the second end of the housing. In one example, a second distance between the first sound-emitting vent and the fourth sound-emitting vent defines a second effective length of a second loudspeaker dipole, the second effective length being longer than the first effective length. In one example, the first loudspeaker dipole is a high frequency dipole and the second loudspeaker dipole is a low frequency dipole. In one example, the loudspeaker further includes an acoustic transmission line between the acoustic radiator and the fourth sound-emitting vent configured to transmit sound pressure.

In one example, the first sound-emitting vent includes an opening in the housing covered by a resistive screen having a lowest possible resistance and a hydrophobic coating. In one example, the fourth sound-emitting vent includes a port opening.

In one example, the loudspeaker further includes an extension member removably attachable to a headset configured to be worn on a user's head, wherein the acoustic radiator is held near but not covering an ear of the user when the loudspeaker is worn. In one example, when the extension member is attached to a headset, the extension member is slideable relative to the headset.

In one example, the first, second, third, and fourth sound-emitting vents include first, second, third, and fourth port openings, respectively, and the first port opening receives either the front-side acoustic radiation or the rear-side acoustic radiation, and the second, third, and fourth port openings receive either the front-side acoustic radiation or the rear-side acoustic radiation but do not receive the same acoustic radiation as does the first port opening.

DETAILED DESCRIPTION

Figure 1:
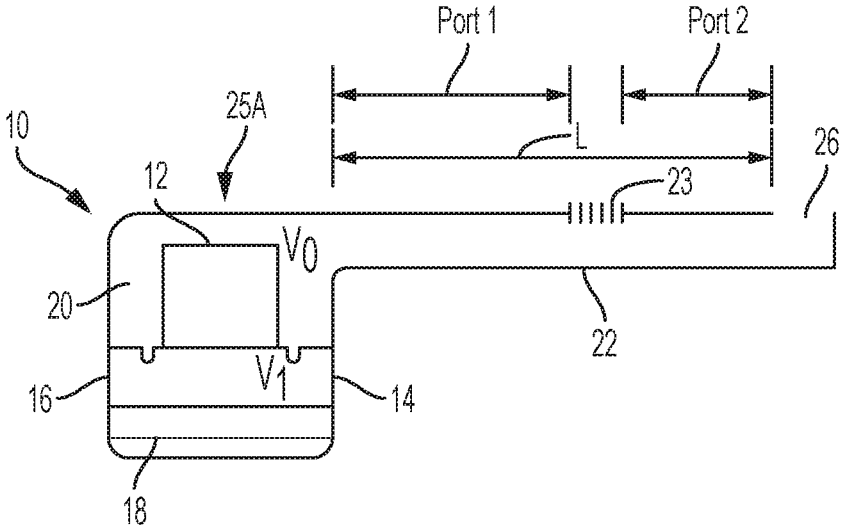
FIG. 1 is partial schematic cross-sectional view of a loudspeaker taken along line 1-1 in FIG. 2B.

This disclosure relates to off-ear acoustic systems including one or more transducers configured to emit front-side acoustic radiation from its front side, and emit rear-side acoustic radiation from its rear side. A housing directs the front-side acoustic radiation and the rear-side acoustic radiation. A plurality of sound-conducting vents in the housing allow sound to leave the housing. A distance between vents defines an effective length of an acoustic dipole of the transducer. The effective length may be considered to be the distance between the two vents that contribute most to the emitted radiation at any particular frequency. The housing and its vents are constructed and arranged such that the effective dipole length is frequency dependent. In one example, the transducer is a loudspeaker with an acoustic radiator that emits acoustic radiation. The transducer is able to achieve a greater ratio of sound pressure delivered to the ear to spilled sound as compared to an off-ear headphone not having this feature.

Applicant has recognized and appreciated that it would be beneficial to have multiple sound-conducting openings or vents at an end of the dipole, and in particular, multiple vents at the end of the dipole associated with high frequencies. A particular goal of utilization of certain examples of the present disclosure is to split the high frequency dipole into multiple openings to shorten dipole length due to the large diameter driver.

Exemplary loudspeakers according to the present disclosure include an acoustic radiator configured to emit front-side acoustic radiation from a front side and rear-side acoustic radiation from a rear side; a housing that directs the front-side acoustic radiation and the rear-side acoustic radiation; and a plurality of sound-emitting vents arranged in the housing. The plurality of sound-emitting vents includes a first sound-emitting vent arranged in an end of the housing closest to the ear canal and a second sound-emitting vent in an opposite end of the housing farther away from the ear. A first distance between the first and second sound-emitting vents defines a first effective length of a first loudspeaker dipole. The plurality of sound-emitting vents further includes third and fourth sound-emitting vents arranged in the housing. A second distance between the first sound-emitting vent and the third or fourth sound-emitting vents defines a second effective length of a second loudspeaker dipole. The second effective length is shorter than the first effective length.

A headphone refers to a device that typically fits around, on, or in an ear and that radiates acoustic energy into the ear canal. This disclosure describes types of headphones that fit near, but do not block the ear. These types of headphones are also referred to as off-ear headphones. Headphones can also be referred to as earphones, earpieces, headsets, earbuds, or sport headphones, and can be wired or wireless. A headphone includes an acoustic driver to transduce audio signals to acoustic energy. The acoustic driver may be housed in an earcup or earbud, or other housing. While some of the figures and descriptions following show a single headphone, a headphone may be a single stand-alone unit or one of a pair of headphones (each including at least one acoustic driver), one for each ear. A headphone may be connected mechanically to another headphone, for example, by a headband and/or by leads that conduct audio signals to an acoustic driver in the headphone. A headphone may include components of an active noise reduction (ANR) system. In an around, on-ear, or off-ear headphone, the headphone may include a headband and at least one housing that is arranged to sit on or over or proximate an ear of the user.

Exemplary loudspeaker 10 is depicted in FIG. 1, which is a schematic longitudinal cross-section. Loudspeaker 10 includes acoustic radiator 12 that is located within housing 14. In some examples, an acoustic transducer is used instead of an acoustic radiator. Housing 14 is closed, or essentially closed, except for a number of sound-emitting vents. The housing and its vents are constructed and arranged to achieve a desired sound pressure level (SPL) delivery to a particular location, while minimizing sound that is spilled to the environment. These results make loudspeaker 10 an effective off-ear headphone. However, this disclosure is not limited to off-ear headphones, as the loudspeaker is also effective in other uses such as open-air speakers that can only be clearly heard from specific locations, which can include speakers built into a headrest or another part of a seat in an automobile, and speakers for movie theaters, arcade games and casino games, for example.

Housing 14 defines an acoustic radiator front volume 16, which is identified as "$V_1$," and an acoustic radiator rear volume 20, which is identified as "$V_0$." Acoustic radiator 12 radiates sound pressure into both front volume 16 and rear volume 20, the sound to the two different volumes being out of phase. Housing 14 thus directs both the front side acoustic radiation and the rear side acoustic radiation. Housing 14 includes four (and in some cases more) vents in this non-limiting example—front open vent 18 (which could optionally be covered by a resistive screen to make for a more ideal dipole, as is further explained below), rear openings 25A, 25B (see FIGS. 2A and 2B) each of which can be covered by a resistive screen, and rear port opening 26 which is located at the distal end of port 22 (i.e., acoustic transmission line). An acoustic transmission line is a duct that is adapted to transmit sound pressure, such as a port or an acoustic waveguide. A port and a waveguide typically have acoustic mass. Second rear opening 23 covered by a resistive screen is an optional active element that can be included to damp standing waves in port 22, as is known in the art. When this disclosure refers to a resistive screen, the resistive component exhibits a lowest possible resistance so as not to disturb acoustic performance and serves to keep waste or debris from entering the acoustic chambers, and even liquids if the screen is hydrophobically coated. Without screened opening 23, at the frequency where the port length equals half the wavelength, the impedance to drive the port is very low, which would cause air to escape through the port (through rear port opening 26) rather than screened openings 25A and 25B. When screened opening 23 is included, the distances along port 22 may be broken down into distance "port 1" from the entrance of port 22 to opening 23, and distance "port 2" from opening 23 to opening 26. Note that any acoustic opening has a complex impedance, with a resistive (energy dissipating) component and a reactive (non-dissipating) component. When this disclosure refers to an opening as resistive, the resistive component is dominant.

A front vent and a rear vent radiate sound to the environment outside of housing 14 in a manner that can be equated to an acoustic dipole. One dipole would be accomplished by vent 18 and vents 25A and 25B. A second, longer, dipole would be accomplished by vent 18 and vent 26. An ideal acoustic dipole exhibits a polar response that consists of two lobes, with equal radiation forwards and backwards along a radiation axis, and no radiation perpendicular to the axis. Loudspeaker 10 as a whole exhibits acoustic characteristics of an approximate dipole, where the effective dipole length or moment is not fixed, i.e., it is variable. The effective length of the dipole can be considered to be the distance between the vents that contribute the most to acoustic radiation at any particular frequency. In the present example, the variability of the dipole length is frequency dependent. Thus, housing 14 and vents 18, 25A, 25B, and 26 are constructed and arranged such that the effective dipole length of loudspeaker 10 is frequency dependent.

The variability of the dipole length impacts which vents dominate at what frequencies. A lower impedance equates to greater outputted volume velocity. At any particular frequency, the output from any or all of the back-side vents can contribute to the sound emitted from the loudspeaker. However, at most frequencies the impedance of one of the back-side vents will be lower than that of the others, and thus the sound pressure delivered from that vent, as well as the front-side vent, will dominate the loudspeaker output. At low frequencies vent 26 dominates over vents 25A and 25B, and so the dipole length is long. At high frequencies, vents 25A and 25B dominate (in volume velocity) over vent 26, and so the dipole spacing is short. In systems including larger drivers within rear space 20, Applicant has recognized and appreciated it is advantageous to split the high frequency dipole into multiple openings or vents (e.g., vents 25A and 25B) so that they can be arranged closer to vent 18 arranged in the end of port 22 closest to the ear.

One or more vents on the front side of the transducer and one or more vents on the rear side of the transducer create dipole radiation from the loudspeaker. When used in an open personal near-field audio system (such as with off-ear headphones), there are two main acoustic challenges that are addressed by the variable-length dipole loudspeakers of the present disclosure. Headphones should deliver sufficient SPL to the ear, while at the same time minimizing spillage to the environment. The variable length dipoles of the present loudspeakers allow the loudspeaker to have a relatively large effective dipole length at low frequencies and a smaller effective dipole length at higher frequencies, with the effective length relatively smoothly transitioning between the two frequencies. For applications where the sound source is placed near but not covering an ear, what is desired is high SPL at the ear and low SPL spilled to bystanders (i.e., low SPL farther from the source). The SPL at the ear is a function of how close the front and back sides of the dipole are to the ear canal. Having one dipole source close to the ear and the other far away causes higher SPL at the ear for a given driver volume displacement. This allows a smaller driver to be used. However, spilled SPL is a function of dipole length, where larger length leads to more spilled sound. For a headphone, in which the driver needs to be relatively small, at low frequencies driver displacement is a limiting factor of SPL delivered to the ear. This leads to the conclusion that larger dipole lengths are better at lower frequencies, where spillage is less of a problem because humans are less sensitive to bass frequencies as compared to mid-range frequencies. At higher frequencies, the dipole length should be smaller.

Figure 2A:
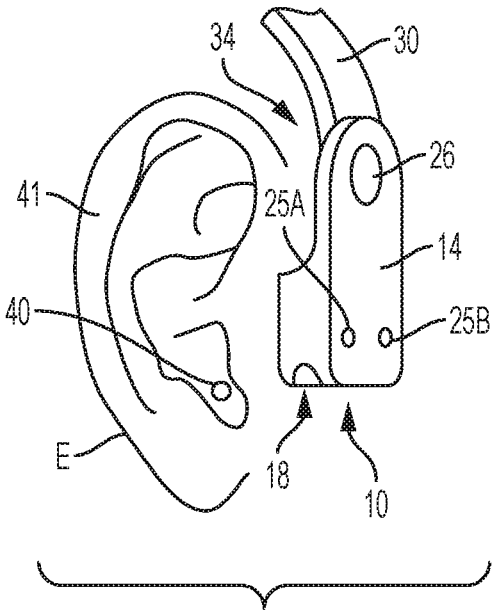
FIG. 2A is a rear perspective view of the loudspeaker of FIG. 1 in use near the ear of a user.
Figure 2B:
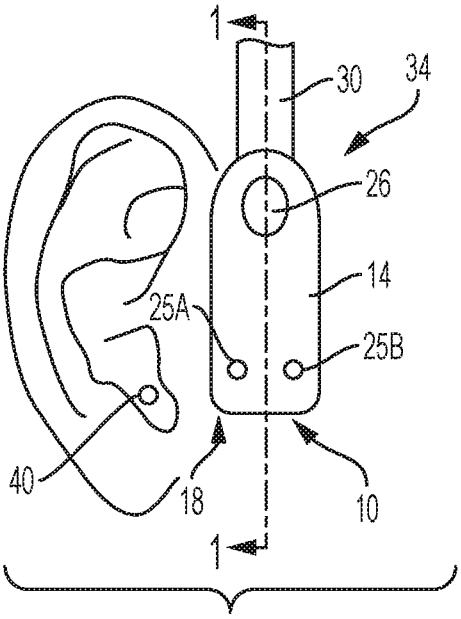
FIG. 2B is a side view of the loudspeaker of FIG. 1 in use near the ear of a user.

In some non-limiting examples herein, the loudspeaker is used to deliver sound to an ear of a user, for example, as part of a headphone. An exemplary headphone 34 is depicted in FIGS. 2A and 2B. Loudspeaker 10 is positioned to deliver sound to ear canal 40 of ear E with pinna 41. Housing 14 is carried by headband 30, such that the acoustic radiator is held near but not covering the ear. While FIGS. 2A and 2B show housing 14 being carried by headband 30, other mechanisms may be used to mechanically couple headphone 34 to ear E, such as a behind-the-ear housing or a napeband. Although headphone 34 is shown a distance from the ear canal in FIGS. 2A and 2B for illustration purposes, in practice headphone 34 is positioned closer to the ear canal. For example, when in use, headphone 34 is arranged such that vent 18 is essentially covering ear canal 40. Other details of headphone 34 that are not relevant to this disclosure are not included, for the sake of simplicity. Front vent 18 is closer to ear canal 40 than are back vents 25A, 25B, and 26. Vent 18 is preferably located anteriorly of pinna 41 and pointed toward and close to the ear canal, so that sound escaping vent 18 is not blocked by or substantially impacted by the pinna before it reaches the ear canal. As can be seen in the side view of FIG. 2B, vents 25A, 25B, and 28 are directed away from the user's head. The area of the vents 18, 25A, 25B, and 26 should be large enough such that there is minimal flow noise due to turbulence induced by high flow velocity. It should be appreciated that in practice vent 25A is spaced apart from vent 25B such that radiator 12 is positioned between vents 25A and 25B. Note that this arrangement of vents is illustrative of principles herein and is not limiting of the disclosure, as the location, size, shape, impedance, and quantity of vents can be varied to achieve particular sound-delivery objectives, as would be apparent to one skilled in the art.

One side of the acoustic radiator (the front side in the example of FIGS. 1 and 2) radiates through a vent (e.g., vent 18) that is close to the ear canal. The other side of the driver can force air through one or more screens (e.g., vents 25A and 25B), or down a port (e.g., port 22). When the impedance of the port is high (at relatively high frequencies), acoustic pressure created at the back of the radiator escapes primarily through the screens. When the impedance of the port is low (at relatively low frequencies), the acoustic pressure escapes primarily through the end of the port. Thus, placing the screened vents closer than the port opening to the front vent accomplishes a longer effective dipole length at lower frequencies, and a smaller effective dipole length at higher frequencies. The housing and vents of the present loudspeaker are preferably constructed and arranged to achieve a longer effective dipole length at lower frequencies, and a smaller effective dipole length at higher frequencies.

Figure 3:
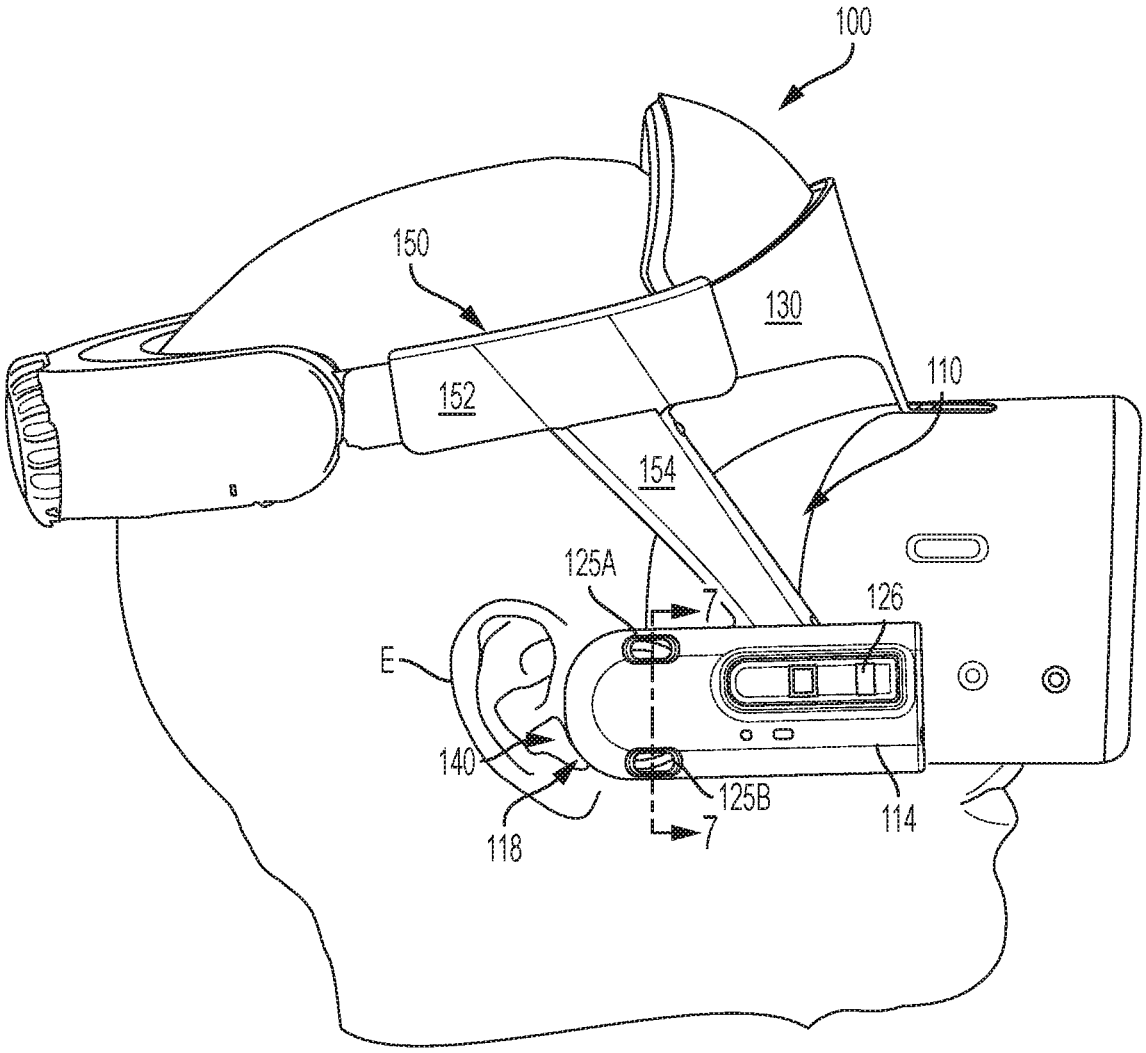
FIG. 3 is a rear perspective view of a loudspeaker attached to a headset assembly.
Figure 4:
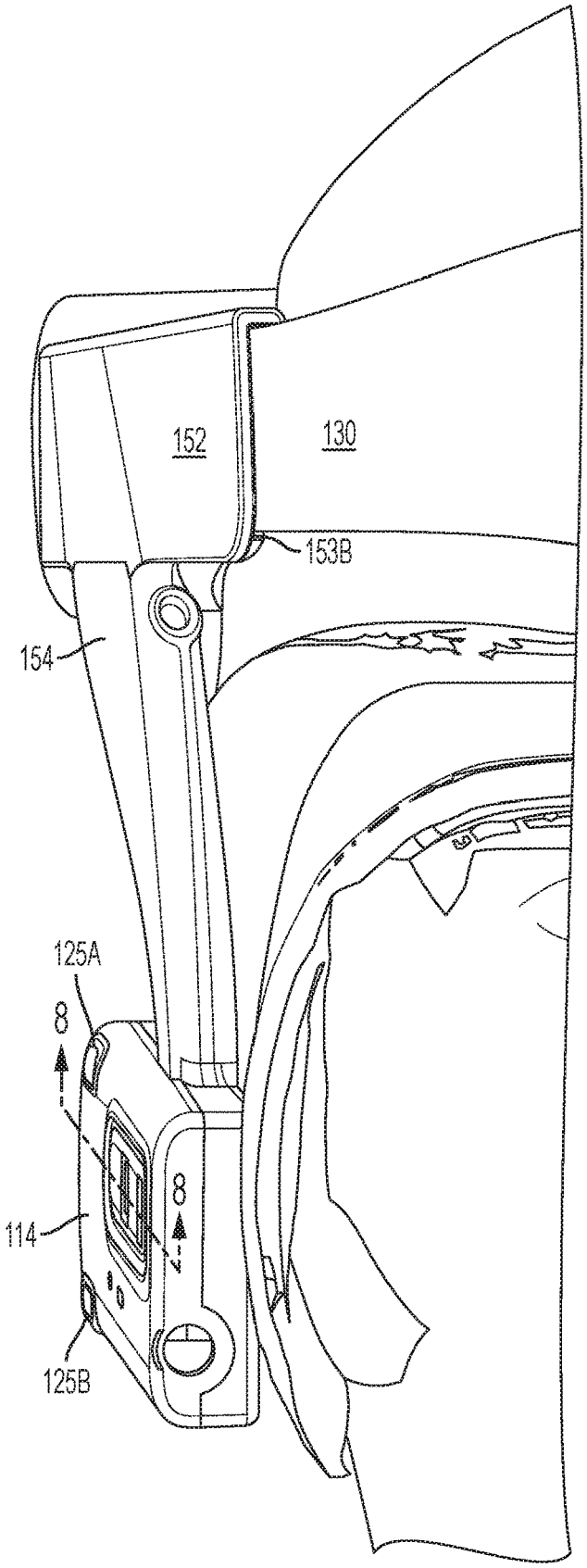
FIG. 4 is an end perspective view of the loudspeaker attached to the headset assembly of FIG. 3.
Figure 5:
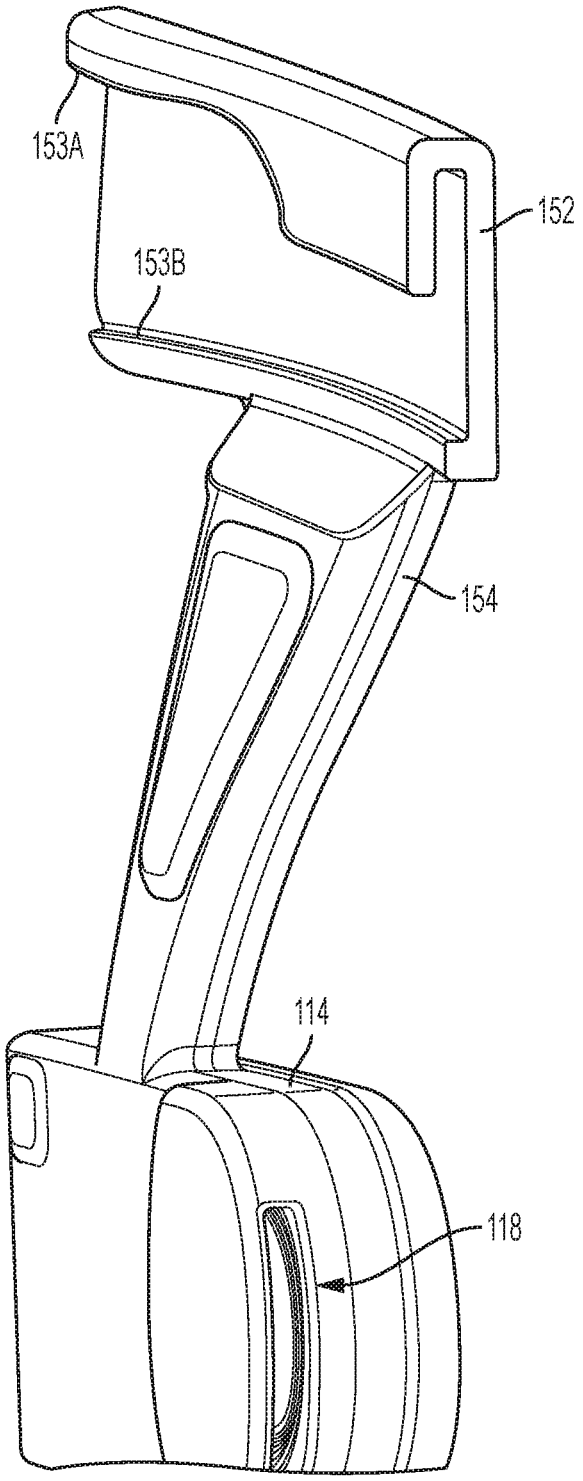
FIG. 5 is an end perspective view of the loudspeaker of FIG. 4 in isolation rotated approximately 180 degrees.
Figure 6:
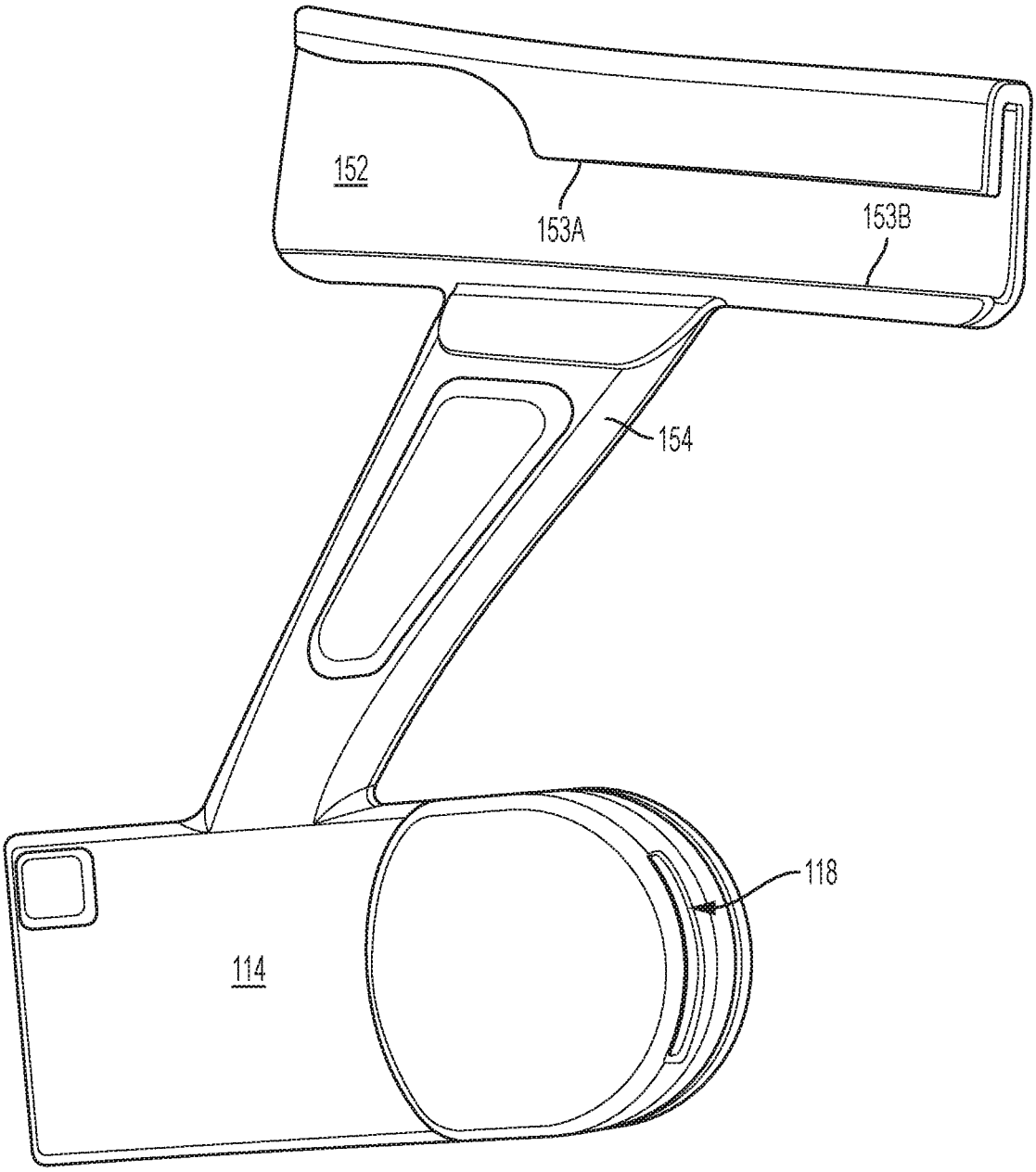
FIG. 6 is front perspective view of the loudspeaker of FIG. 5.
Figure 7:
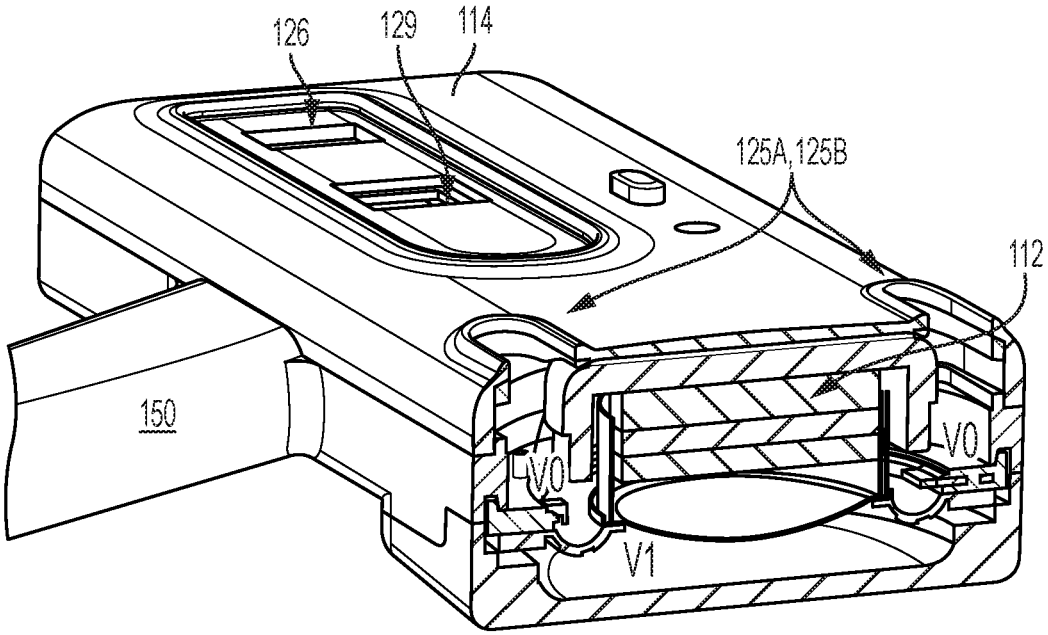
FIG. 7 is a partial cross-sectional view of the loudspeaker taken generally along line 7-7 in FIG. 3.
Figure 8:
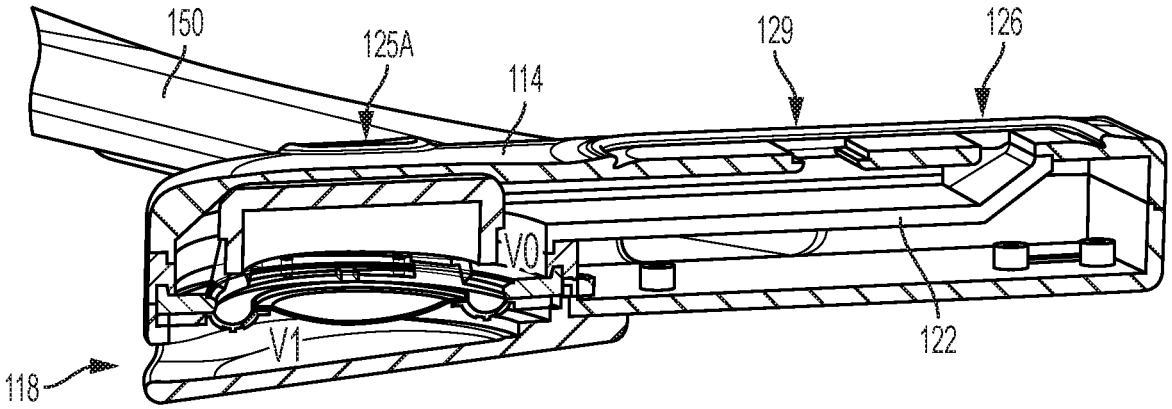
FIG. 8 is a partial cross-sectional view of the loudspeaker taken generally along line 8-8 in FIG. 4.

The loudspeakers can take myriad other forms, as would be apparent to one skilled in the art. FIGS. 3-8 show an exemplary loudspeaker 110 removably attachable to a headset assembly 100. In some examples, headset assembly 100 is a virtual reality headset. FIG. 3 is a rear perspective view of loudspeaker 110 attached to headset assembly 100. FIG. 4 is an end perspective view of loudspeaker 110 attached to headset assembly 100. FIG. 5 is an end perspective view of loudspeaker 110 of FIG. 4 in isolation rotated approximately 180 degrees. FIG. 6 is front perspective view of loudspeaker 110. FIG. 7 is a partial cross-sectional view of loudspeaker 110 taken generally along line 7-7 in FIG. 3. Lastly, FIG. 8 is a partial cross-sectional view of loudspeaker 110 taken generally along line 8-8 in FIG. 4. The following should be viewed in light of FIGS. 3-8. Loudspeaker 110 includes acoustic radiator 112, housing 114, port 122, vents 118, 125A, 125B, 126, and extension member 150. Loudspeaker 110 is used to deliver sound to an ear of a user as part of a headphone, for example. Although only a single loudspeaker 110 is shown in FIGS. 3-8, it should be appreciated that headset assembly 100 can include two loudspeakers for each ear of a wearer.

As shown in FIG. 3, loudspeaker 110 is positioned to deliver sound to ear canal 140 of ear E. Loudspeaker 110 includes acoustic radiator 112 arranged within housing 114. Housing 114 is closed, or essentially closed, except for the sound-emitting vents as described herein. The housing and its vents are constructed and arranged to achieve a desired SPL delivery to a particular location, while minimizing sound that is spilled to the environment. Loudspeaker 110 achieves high-quality, open-ear, low-leak audio sound.

Housing 114 is carried by headband 130 via extension member 150, such that acoustic radiator 112 within housing 114 is held near but not covering ear E. As shown in FIG. 3, one side of housing 114 faces toward the wearer and the opposite side of housing 114 faces away from the wearer. The sound-emitting vents include front vent 118 arranged in the side of housing 114 facing toward the wearer and the end of housing 114 that is closest to ear canal 140. The sound-emitting vents also include rear vents 125A, 125B, and 126 which are arranged farther from ear canal 140 in a substantially horizontal direction (as opposed to the vertical direction shown in FIGS. 1-2B). Vent 118 is preferably located anteriorly of pinna and pointed toward and close to the ear canal, so that sound escaping vent 118 is not blocked by or substantially impacted by the pinna before it reaches the ear canal. As can be seen in the FIG. 3, vents 125A, 125B, and 126 are directed away from the user's head within the rear of housing 114. The area of the vents 118, 125A, 125B, and 126 should be large enough such that there is minimal flow noise due to turbulence induced by high flow velocity.

Extension member 150 includes portions 152 and 154 which may be separate parts that are connectable or integral. It should be appreciated that extension member 150 can be part of housing 114 or separately formed and attachable to housing 114. Portion 152 is configured to include an opening along its length. As shown in FIGS. 5 and 6, portion 152 includes edges 153A and 153B which extend along the length of portion 152. In some examples, edges 153A and 153B are the same length. However, in alternate examples, edges 153A and 153B can be different lengths. In some examples, edge 153A can include a planar portion and a curved portion, and edge 153B can include only a planar portion. However, it should be appreciated that edge 153B could include a planar portion and a curved portion and edge 153A could include only a single planar portion instead. It should further be appreciated that this disclosure is not limited to the configuration shown and other suitable configurations that achieve the same functions are contemplated.

Portion 152 forms a hollow rounded rectangular shape from edge 153A to edge 153B in a clockwise direction in FIGS. 5 and 6, however edge 153B does not contact edge 153A. Due to the space between edges 153A and 153B, headband 130 can be received within the hollow part of portion 152. For example, the uppermost edge of headband 130 can be slid into the hollow part such that edge 153A contacts an inner surface of the headband 130 and edge 153B contacts the lowermost edge of headband 130. In FIG. 3, edges 153A and 153B are not visible because edge 153A is between headband 130 and the wearer's head and edge 153B is below headband 130. In FIG. 4, although edge 153A is not visible for the same reason, edge 153B is visible due to the different perspective shown. If headband 130 is made of a suitable transparent material, edge 153A would be visible in both FIGS. 3 and 4.

When headband 130 is received within portion 152 as shown in FIGS. 3 and 4, portion 152 surrounds headband 130 except for the space between edges 153A and 153B as shown in FIGS. 5 and 6. The hollow part of portion 152 is sized to match the size of headband 130. More specifically, the thickness, depth, and curvature of the hollow part of portion 152 corresponds with the thickness, depth, and curvature of the headband 130. In some examples, the hollow part is slightly larger than the headband 130. In some examples, when headband 130 is received within portion 152, portion 152 is slideable relative to the headband 130 so that the placement of loudspeaker 110 can be adjusted. Portion 154 extends from portion 152 to housing 114 such that the acoustic radiator 112 within housing 114 is suspended near an ear of a user wearing headband 130. As shown in FIGS. 1 and 6, when extension member 150 is attached to headband 130 in use, portion 154 extends downwardly and forwardly from headband 130. An acute angle is formed by the side of portion 154 that faces vent 118 and housing 114.

The discussion above regarding the housing 14 of loudspeaker 10 directing acoustic radiation from the front and rear sides also applies to housing 114 of loudspeaker 110. In addition, the discussion above regarding the sound-emitting vents also applies to vents 118, 125A, 125B, and 126. As shown in FIG. 11, housing 114 also includes a port, or an acoustic waveguide, 122 similar to the port 22 included in housing 14. As shown in FIGS. 3-8, housing 114 can include an additional vent, a quiet port 129 covered by a resistive screen to damp standing waves in port 122 similar to opening 23 in loudspeaker 10. A front vent and a rear vent radiate sound to the environment outside of housing 114 in a manner that can be equated to an acoustic dipole as discussed above. A high frequency dipole would be accomplished by vent 118 and vents 125A and 125B. A second, longer, low frequency dipole would be accomplished by vent 118 and vent 126 similar to the dipoles discussed above. Housing 114 and vents 118, 125A, 125B, and 126 are constructed and arranged such that the effective dipole length of loudspeaker 110 is frequency dependent as discussed above with respect to loudspeaker 10.

Since vents 125A and 125B are arranged in parallel, each extending from the end of housing 114 closest to the ear canal to the end of housing 114 farthest from the ear canal, they can be arranged on either side of a larger driver. As shown in FIG. 7, vents 125A and 125B are arranged on either side of radiator 112. Similarly, as shown in FIG. 8, vent 125A is arranged behind the space where radiator 112 would be positioned and vent 125B is not shown. Due to the size of radiator 112, vents 125A and 125B cannot be positioned directly above radiator 112 in housing 114. Since vents 125A and 125B are positioned on either side of radiator, they are positioned a distance away from vent 118 which is smaller than a diameter of radiator 112.

While several inventive examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive examples described herein.

More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive examples described herein. It is, therefore, to be understood that the foregoing examples are presented by way of example only and that, within the scope of the appended claims and equivalents thereto, inventive examples may be practiced otherwise than as specifically described and claimed. Inventive examples of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A loudspeaker, comprising:

an acoustic radiator having a front side and a rear side, said acoustic radiator configured to emit front-side acoustic radiation from said front side and rear-side acoustic radiation from said rear side;

a housing that directs said front-side acoustic radiation and said rear-side acoustic radiation; and a plurality of sound-emitting vents arranged in said housing, said plurality of sound-emitting vents comprising a first sound-emitting vent arranged in a first end of said housing and a second sound-emitting vent in a second end of said housing, a first distance between said first and second sound-emitting vents defining a first effective length of a first loudspeaker dipole, said plurality of sound-emitting vents further comprising third and fourth sound-emitting vents, a second distance between said first sound-emitting vent and each of said third and fourth sound-emitting vents defining a second effective length of a second loudspeaker dipole, said second effective length being shorter than said first effective length, wherein said first loudspeaker dipole is a low frequency dipole and said second loudspeaker dipole is a high frequency dipole, and wherein said first, second, third, and fourth sound-emitting vents comprise first, second, third, and fourth port openings, respectively, and said first port opening receives either said front-side acoustic radiation or said rear-side acoustic radiation, and said second, third, and fourth port openings receive either said front-side acoustic radiation or said rear-side acoustic radiation but do not receive the same acoustic radiation as does said first port opening.

2. The loudspeaker of claim 1, further comprising an acoustic transmission line between said acoustic radiator and said second sound-emitting vent configured to transmit sound pressure.

3. The loudspeaker of claim 1, wherein said first sound-emitting vent comprises an opening in said housing covered by a resistive screen having a first resistance and a hydrophobic coating.

4. The loudspeaker of claim 1, wherein said second sound-emitting vent comprises a port opening.

5. The loudspeaker of claim 1, further comprising an extension member removably attachable to a headset configured to be worn on a user's head, wherein said acoustic radiator is held near but not covering an ear of said user when said loudspeaker is worn.

6. The loudspeaker of claim 5, wherein when said extension member is attached to a headset, said extension member is slideable relative to said headset.

7. The loudspeaker of claim 1, wherein said second effective length is shorter than a diameter of said acoustic radiator.

8. The loudspeaker of claim 1, wherein said third and fourth sound-emitting vents are arranged in parallel and each extends from said first end of said housing to said second end of said housing.

9. An open personal near-field audio system loudspeaker, comprising:

an acoustic radiator having a front side and a rear side, said acoustic radiator configured to emit front-side acoustic radiation from said front side and rear-side acoustic radiation from said rear side;

a housing having first and second ends, said housing configured to direct said front-side acoustic radiation and said rear-side acoustic radiation; and a plurality of sound-emitting vents arranged in said housing, said plurality of sound-emitting vents comprising a first sound-emitting vent arranged in the first end of said housing and in or on a first surface and second and third sound-emitting vents arranged in or on a second surface, wherein the first surface and the second surface are non-parallel, a first distance between said first sound-emitting vent and each of said second and third sound-emitting vents defining a first effective length of a first loudspeaker dipole, said first effective length being shorter than a diameter of said acoustic radiator, wherein the first vent is arranged to be positioned outside of the ear, and wherein said first, second, and third sound-emitting vents comprise first, second, and third port openings, respectively, and said first port opening receives either said front-side acoustic radiation or said rear-side acoustic radiation, and said second and third port openings receive either said front-side acoustic radiation or said rear-side acoustic radiation but do not receive the same acoustic radiation as does said first port opening.

10. The loudspeaker of claim 9, wherein said plurality of sound-emitting vents further comprises a fourth sound-emitting vent in said second end of said housing.

11. The loudspeaker of claim 10, wherein a second distance between said first sound-emitting vent and said fourth sound-emitting vent defines a second effective length of a second loudspeaker dipole, said second effective length being longer than said first effective length.

12. The loudspeaker of claim 9, wherein said first loudspeaker dipole is a high frequency dipole and said second loudspeaker dipole is a low frequency dipole.

13. The loudspeaker of claim 10, further comprising an acoustic transmission line between said acoustic radiator and said fourth sound-emitting vent configured to transmit sound pressure.

14. The loudspeaker of claim 9, wherein said first sound-emitting vent comprises an opening in said housing covered by a resistive screen having a first resistance and a hydrophobic coating.

15. The loudspeaker of claim 10, wherein said fourth sound-emitting vent comprises a port opening.

16. The loudspeaker of claim 9, further comprising an extension member removably attachable to a headset configured to be worn on a user's head, wherein said acoustic radiator is held near but not covering an ear of said user when said loudspeaker is worn.

17. The loudspeaker of claim 16, wherein when said extension member is attached to a headset, said extension member is slideable relative to said headset.

18. A loudspeaker, comprising:

an acoustic radiator having a front side and a rear side, said acoustic radiator configured to emit front-side acoustic radiation from said front side and rear-side acoustic radiation from said rear side;

a housing that directs said front-side acoustic radiation and said rear-side acoustic radiation; and a plurality of sound-emitting vents arranged in said housing, said plurality of sound-emitting vents comprising a first sound-emitting vent arranged in a first end of said housing and a second sound-emitting vent in a second end of said housing, a first distance between each of said first and second sound-emitting vents defining a first effective length of a first loudspeaker dipole, said plurality of sound-emitting vents further comprising third and fourth sound-emitting vents arranged in said housing in parallel and each extends from said first end of said housing to said second end of said housing, a second distance between said first sound-emitting vent and said third and fourth sound-emitting vents defining a second effective length of a second loudspeaker dipole, said second effective length being shorter than said first effective length.

* * * * *